US008245452B2

(12) United States Patent
Koteskey

(10) Patent No.: US 8,245,452 B2
(45) Date of Patent: Aug. 21, 2012

(54) MOLDED SECTIONED RISER AND LOCKING COVER

(75) Inventor: Gary L. Koteskey, Boyne City, MI (US)

(73) Assignee: Sim-Tech Filters, Inc., Boyne City, MI (US)

( * ) Notice: Subject to any disclaimer, the term of this patent is extended or adjusted under 35 U.S.C. 154(b) by 0 days.

(21) Appl. No.: 12/814,173

(22) Filed: Jun. 11, 2010

(65) Prior Publication Data

US 2010/0242377 A1 Sep. 30, 2010

Related U.S. Application Data

(60) Division of application No. 11/515,626, filed on Sep. 5, 2006, now Pat. No. 7,966,786, which is a continuation-in-part of application No. 10/607,225, filed on Jun. 26, 2003, now abandoned.

(51) Int. Cl.
*E02D 29/12* (2006.01)

(52) U.S. Cl. ..... 52/19; 52/20; 52/169.6; 52/245; 52/590.1; 52/590.2; 174/37; 220/4.04; 220/4.26; 405/133; 405/134; 405/140

(58) Field of Classification Search .... 52/169.1–169.14, 52/170, 83, 128, 19–21, 592.1, 651.01, 169.6, 52/590.1, 592.5, 592.6, 590.2, 142, 79.1, 52/79.7, 134–137, 139, 141, 245; 220/4.26, 220/4.03, 4.04, 4.07, 4.08; 206/503–511, 206/515; 404/25–26; 174/37, 39; 405/41, 405/43, 80, 83, 161, 132–140
See application file for complete search history.

(56) References Cited

U.S. PATENT DOCUMENTS

| | | | | | |
|---|---|---|---|---|---|
| 58,859 | A | | 10/1866 | McCormick | |
| 289,663 | A | | 12/1883 | Langill | |
| 897,046 | A | | 8/1908 | Armstrong | |
| 1,448,648 | A | * | 3/1923 | Wilkins | 52/590.2 |
| 1,783,893 | A | | 12/1929 | Grady | |
| 2,488,796 | A | | 11/1949 | Baier | 114/201 |
| 2,882,714 | A | * | 4/1959 | Gagle et al. | 52/604 |
| 3,039,534 | A | | 6/1962 | Koop | 166/123 |
| 3,131,825 | A | | 5/1964 | Sarafinas | 220/24.5 |
| 3,230,844 | A | | 1/1966 | Isaacs | 94/34 |
| 3,291,437 | A | * | 12/1966 | Bowden et al. | 249/48 |
| 3,358,870 | A | | 12/1967 | Larkins | 220/27 |
| 3,390,224 | A | | 6/1968 | Wyatt | 174/37 |
| 3,562,988 | A | * | 2/1971 | Gegoire | 52/279 |
| 3,611,889 | A | | 10/1971 | Levinson | 94/34 |

(Continued)

*Primary Examiner* — Jeanette E. Chapman
(74) *Attorney, Agent, or Firm* — Brinks Hofer Gilson & Lione

(57) ABSTRACT

A riser formed from a plurality of curved cylindrical segments with vertical side edges having mating vertically tapered projections and slots brought into interlocking engagement to pull confronting surfaces together as the tapered elements become increasingly mechanically engaged. The segments are assembled by a sliding engagement of the protruding mating element of one segment into the vertically tapered slot of an adjacent segment. When sufficient segments are joined together horizontally to complete a ring except for a last adjacent pair of vertical side edges, the ring is warped to align the protruding mating element of the last adjacent pair of vertical side edges with an opposite end of the adjacent tapered slot. Thus aligned, the final protruding mating element and tapered slot are then slipped together while un-warping the joined segments forming the remainder of the ring until the top and bottom ends of all the segments are aligned. A cover has a flexible spider on a lower surface that can be locked into a groove or other feature on an inside surface of the curved riser segments.

14 Claims, 13 Drawing Sheets

U.S. PATENT DOCUMENTS 3,695,044 A 10/1972 Hoshino et al. ..... 61/42
3,826,032 A 7/1974 Torngren ..... 43/100
3,951,294 A * 4/1976 Wilson ..... 220/4.31
4,003,172 A * 1/1977 Pawl ..... 52/279
4,007,555 A * 2/1977 Sasaoka ..... 446/127
4,015,373 A 4/1977 Boissier ..... 52/20
4,066,125 A 1/1978 Bassani ..... 166/202
4,075,855 A 2/1978 Meldner ..... 61/45 R
4,101,154 A 7/1978 Kågström ..... 292/237
4,125,394 A * 11/1978 Wilson ..... 71/9
4,294,331 A 10/1981 Reynoir et al. ..... 182/10
4,310,372 A 1/1982 Janssen et al. ..... 156/245
4,352,512 A 10/1982 Janssen et al. ..... 285/419
4,387,825 A 6/1983 Parent ..... 220/234
4,523,407 A 6/1985 Miller ..... 49/465
4,537,325 A 8/1985 Zieff ..... 220/234
4,597,112 A 7/1986 Cuschera ..... 4/287
4,632,602 A * 12/1986 Hovnanian ..... 405/129.8
4,850,136 A 7/1989 Vollers ..... 47/73
4,877,224 A 10/1989 Watts ..... 267/140
4,905,442 A * 3/1990 Daniels ..... 52/588.1
4,964,755 A 10/1990 Lewis et al. ..... 404/25
5,060,416 A 10/1991 Rohde ..... 47/23
5,081,802 A 1/1992 Westhoff et al. ..... 52/20
5,265,974 A * 11/1993 Dargie ..... 404/4
5,386,646 A 2/1995 Saarikettu ..... 34/582
5,525,006 A 6/1996 Kilman et al. ..... 404/25
5,528,857 A 6/1996 Ashleigh et al. ..... 47/78
5,608,998 A 3/1997 Hume ..... 52/245
5,628,152 A 5/1997 Bowman ..... 52/20
5,775,046 A * 7/1998 Fanger et al. ..... 52/590.1
5,787,955 A * 8/1998 Dargie ..... 160/368.1
5,845,442 A 12/1998 Strehlow ..... 52/302.7
5,864,998 A * 2/1999 Loomer ..... 52/271
5,881,511 A * 3/1999 Keller, Jr. ..... 52/220.2
5,930,972 A 8/1999 Benner et al. ..... 52/653.1
5,979,117 A 11/1999 Fuller ..... 52/19
5,987,824 A 11/1999 Fuller ..... 52/19
6,007,270 A 12/1999 Bowman ..... 404/25
6,018,914 A * 2/2000 Kamiyama et al. ..... 52/20
6,151,856 A * 11/2000 Shimonohara ..... 52/426
6,286,281 B1 * 9/2001 Johnson ..... 52/592.1
6,311,433 B1 11/2001 Zdroik ..... 52/20
6,347,781 B1 2/2002 Trangsrud ..... 249/11
6,357,194 B1 3/2002 Jones, Jr. ..... 52/590.1
6,431,789 B2 8/2002 Schneider et al. ..... 404/26
6,484,451 B1 11/2002 Gavin ..... 52/20
6,527,476 B1 3/2003 Pettesch ..... 404/26
6,584,734 B2 7/2003 Mihalicz et al. ..... 52/19
6,655,093 B1 12/2003 Gavin ..... 52/20
6,682,257 B1 1/2004 Zappe ..... 404/25
6,773,206 B2 8/2004 Bradley et al. ..... 405/215
6,887,012 B1 5/2005 Zappe ..... 404/25
7,025,540 B2 * 4/2006 MacDonald et al. ..... 405/281
7,818,925 B2 * 10/2010 Benedict ..... 52/169.5

* cited by examiner

MOLDED SECTIONED RISER AND LOCKING COVER

CROSS-REFERENCE TO RELATED APPLICATIONS

This application is a divisional application of application Ser. No. 11/515/626 filed on Sep. 5, 2006, now U.S. Pat. No. 7,966,786 which is a continuation-in-part of application Ser. No. 10/607,225 filed Jun. 26, 2003, now abandoned each of which is hereby incorporated by reference.

BACKGROUND

1. Technical Field

This disclosure relates to subterranean structures, particularly vertical access passages to generally underground facilities, such as septic tanks and pump chambers, the vertical access passages sometimes being referred to as manholes. The present disclosure particularly to elements used in the construction of the walls of such subterranean structures, which are sometimes referred to as risers and covers therefore. The disclosure more particularly relates to cylindrical plastic structures made of a plurality of curved segments that are interlocking and stackable, and to a cover that can be locked to a variety of risers of various types.

2. Background Information

There have been previous attempts to construct the walls of manholes and other subterranean structures using a plurality of curved segments. In U.S. Pat. No. 4,751,799, a liner segment is formed in a vacuum forming operation from a heated plastic sheet, which is drawn against the surface of a suitably formed mold member to form certain prescribed outwardly extending projections. A plurality of such liner sections are then joined together using simple lap joints and placed within another mold assembly with an optional inner support and with the liner sections being spaced from the mold assembly. Concrete or other casting material is the poured into the space between the liner sections and the mold assembly with the outwardly extending projections of the liner acting to bond the liner to the casting. Other patents disclosing similar liners are U.S. Pat. Nos. 5,081,802; 5,236,298; 5,303,518; 5,383,311; 5,901,506; and 6,206,609. In all these disclosures, the liner forms a corrosion barrier for the structure, but does not have sufficient strength to constitute the only structural component of the riser.

Other liner segments can also be found, for example, in Hume U.S. Pat. No. 5,608,998, which use the liner segments to rehabilitate an existing, leaking manhole structure. The liner segments are rigid or semi-rigid plastic, and preferably corrugated, panels joined together laterally with an adhesive in a simple lap joint. A plurality of the liner segments are assembled within an existing manhole with a lower end of each ring including a channel or lip that captures the upper end of the next lower ring. Each liner segment of Hume is disclosed to include an integral L-shaped channel which is adapted to receive the opposite end of an identical panel that has no special end structure thereby permitting the panel assembly to be cut to fit a specific manhole perimeter without special forming tools. Once the liner is in place, a bonding layer of polymer foam or other material is injected between the pre-existing manhole structure and the newly formed liner. While the liner has sufficient strength to be self supporting, there is a continuing reliance on the physical strength of the pre-existing leaking manhole to provide some of the structural strength for the structure of the riser as a whole. In the event of a significant structural failure of the pre-existing leaking manhole, the simple overlapping end structure of the liner may be insufficient to prevent the manhole from collapsing inward.

Another structure formed of segments joined end to end is found in U.S. Pat. No. 4,310,372, which discloses couplings and well screens formed of three identical molded pieces joined edge to edge along longitudinal edges by C-shaped clamps slipped onto or snapped over outwardly protruding portions of the joined structure. The edges of each of the three molded pieces include various triangular ridges and grooves forming confronting, but not interlocking, surfaces, which are intended to be solvent welded together. The solvent welds in conjunction with the additional locking means provided by the C-shaped clamps hold the assembled sections together.

One-piece molded plastic structures that are intended for subterranean placement in a variety of fluid containment systems are disclosed in U.S. Pat. Nos. 5,257,652; 5,333,490; 5,361,799; 5,423,447; 5,833,392; 5,988,944; 6,059,208; and 6,189,717. All of the disclosed structures rely substantially entirely on the strength of the plastic materials forming the structures to resist the forces that might be applied by the surrounding soils. Further, it is known to stack structurally self sufficient component formations from U.S. Pat. Nos. 5,617,679 and 5,852,901. While all these structures use the inherent advantages of the various disclosed polymers and plastics to achieve certain desirable results, all these structures are bulky to transport.

Underground reinforced plastic enclosures made of a plurality curved segments that are more easily transported are disclosed in U.S. Pat. Nos. 3,974,599 and 4,089,139. In the earlier of these two disclosures, the curved segments take the form of semi-cylindrical portions having confronting longitudinal edges including outwardly projecting flanges. The flanges are coupled together with bolts and nuts to form the cylindrical members from the semi-cylindrical portions. In the later of these two disclosures, a number of the curved segments, preferably three, are coupled together to form each ring of the structure. Each of the segments includes vertical side edges that are configured to provide an engaging relationship between the laterally adjacent segments. In particular, one of the vertical side edges is disclosed to include a notch formed by the inner surface of the wall segment and an intersecting inclined wall portion. The other vertical side edge includes a projecting tongue having one surface aligned approximately with the inner surface of the remainder of the wall segment and another surface angled at about the same angle as the intersecting inclined wall portion. The projecting tongue can be seen as a wedge that is adhesively secured in the notch to join adjacent segments together to form a ring, but this amounts to no more than an improved lap joint structure having increased adhesive surface area.

Subterranean openings such as vertical manholes desirably have features to prevent entry by unauthorized personnel. One such entry prevention system consists merely of a cover that desirably is locked to the side structure defining the subterranean opening. Examples of such locking covers are to be found in U.S. Pat. Nos. 897,046; 4,015,373; 4,101,154; 4,523,407; 4,964,755; 5,628,152; 5,845,442; 5,979,117; 5,987,824; and 6,584,734. Many such locking covers require a specific orientation with respect to the side structure of the subterranean opening to permit an interlocking engagement of the locking element with specific mating structures in the side structure. Some locking structures are adapted to have an outer portion that simply protrudes under a flange or ledge, but still requires manipulation of more or less complex mechanisms to achieve the necessary outward protrusion of the outer portion.

Another such entry prevention system shown in U.S. Pat. No. 5,265,974 comprises a safety net situated below the cover of a manhole type access opening. The safety net assembly has at least two rigid rods of a length sufficient to span the access opening. Each rod is supported at both ends by a support coupled to the manhole so that at least one of the rods is movable from one side of the access opening to an opposite side. A web or net is securely attached to all the rods to travel with any movement of the rods from one side of the access opening to the opposite side. The web or net has openings sufficiently small to prevent the entry of unauthorized personnel. When unlocked, the rods can be moved between a secured position and an open position.

There remains a need for a reinforced plastic enclosure suited for subterranean use as a structurally defining portion of a manhole that is constructed from a plurality of easily transported curved segments that includes vertical side edges having specific structural features that will lock adjacent segments together without a required use of any adhesive or separate fasteners. There is an additional need for a lockable lid that will cooperatively engage a top opening of a subterranean structure defined by the assembled segments. There is a further need for a security device that will inhibit accidental entry into a subterranean structure defined by the assembled segments.

BRIEF SUMMARY

Accordingly, a subterranean structure can be formed from a plurality of wall elements in the form of easily transported curved segments. Each curved segment can be viewed as being cylindrically curved about a vertical axis and having an inside surface and an outside surface. Each segment has vertical side edges and horizontal top and bottom ends. A first vertical side edge includes a protruding mating element that is vertically tapered. The second vertical side edge has a slot that is also vertically tapered. The vertical side edges include confronting surfaces adapted to be brought into abutting relationship in interlocking engagement when assembled with adjacent segments of similar construction. The vertically tapered protruding mating element and slot have surfaces designed to pull the confronting surfaces together as the tapered elements become increasingly mechanically engaged through vertical relative movement of the adjacent edges. The protruding mating element can take the form of a dovetail extending continuously along the first vertical side edge with the dovetail including a distal portion having a width of continuously varying dimension to achieve the vertical taper. The corresponding slot on the second vertical side edge is then also dovetailed and of varying width so that relative vertical relative displacement of two adjacent segments causes the adjacent confronting surfaces to be drawn together.

To assemble the curved segments into a ring, the protruding mating element of one segment is slipped into the vertically tapered slot of an adjacent segment until the top and bottom ends of the adjacent segments are aligned. The preceding operation is repeated with additional segments until sufficient segments are joined together horizontally to complete a ring except for a last adjacent pair of vertical side edges. The segments of the ring are then vertically warped by a distance sufficient to align one end of the protruding mating element of the last adjacent pair of vertical side edges with an opposite end of the adjacent tapered slot. To complete the ring, the aligned protruding mating element and tapered slot are then slipped together while un-warping the joined segments forming the remainder of the ring until the top and bottom ends of all the segments are aligned.

The rings can include a lap portion on either the upper or lower end so that once some rings are assembled, the rings can be stacked one upon another to form a manhole or other subterranean structure of desired vertical height, the lap portion assuring a self centering of the stacked rings. The assembly and stacking of the rings to form the subterranean structure can be achieved without tools, adhesives, or separate fasteners. Of course, various fasteners, adhesives or cements can be used with such structures, if desired. Additionally, each of the segments can include features that permit locking engagement with a closure to prevent unauthorized entry into the subterranean structure, and can include various security devices that will inhibit accidental entry into the subterranean structure defined by the assembled segments. Further, the assembled segments can be combined with a closure to prevent unauthorized entry into the subterranean structure, and can be combined with suitable security devices that will inhibit accidental entry into the subterranean structure defined by the assembled segments.

A locking cover intended to restrict entry into the subterranean structure can include a plate having an upper surface and a lower surface. The locking cover can include an outer depending flange that extends downward from an outer perimeter of the plate. An inner depending flange can extend downward from the lower surface. The outer and inner depending flanges are spaced from each other to receive an upper horizontal end of a riser. A locking element in the nature of a flexible spider having a center portion and a plurality of radially extending legs can be coupled to the lower surface of the cover. The spider can have three or more legs that can flex with respect to the cover to allow radial movement of outer ends of the legs sufficient to lockingly engage a feature adjacent to the upper horizontal end of the riser. The legs of the locking element can be fixed to each other, and can be for differing lengths.

The locking cover can include a central opening to receive a key for unlocking the locking element. The central opening can be a simple cylindrical opening in the center of the locking cover. The key can be an axially symmetric rod having a lower portion dimensioned to be received in the central opening of the locking cover and a shoulder of a greater dimension. The length of the lower portion can be dimensioned to assure the unlocking of the locking element when the shoulder is in contact with the cover upper surface. The key can also include a tapered portion between the lower portion and the shoulder allowing lateral displacement of the key relative to the central opening of the cover. A handle can be provided at one end of the key facilitating lateral displacement of the key in relation to the locking cover to engage the key in an unlocking position.

Other features and advantages of these structures will become apparent to those skilled in the art from the following discussion of a preferred embodiment illustrated in the accompanying drawings.

DETAILED DESCRIPTION OF PREFERRED EMBODIMENTS

Figure 1:
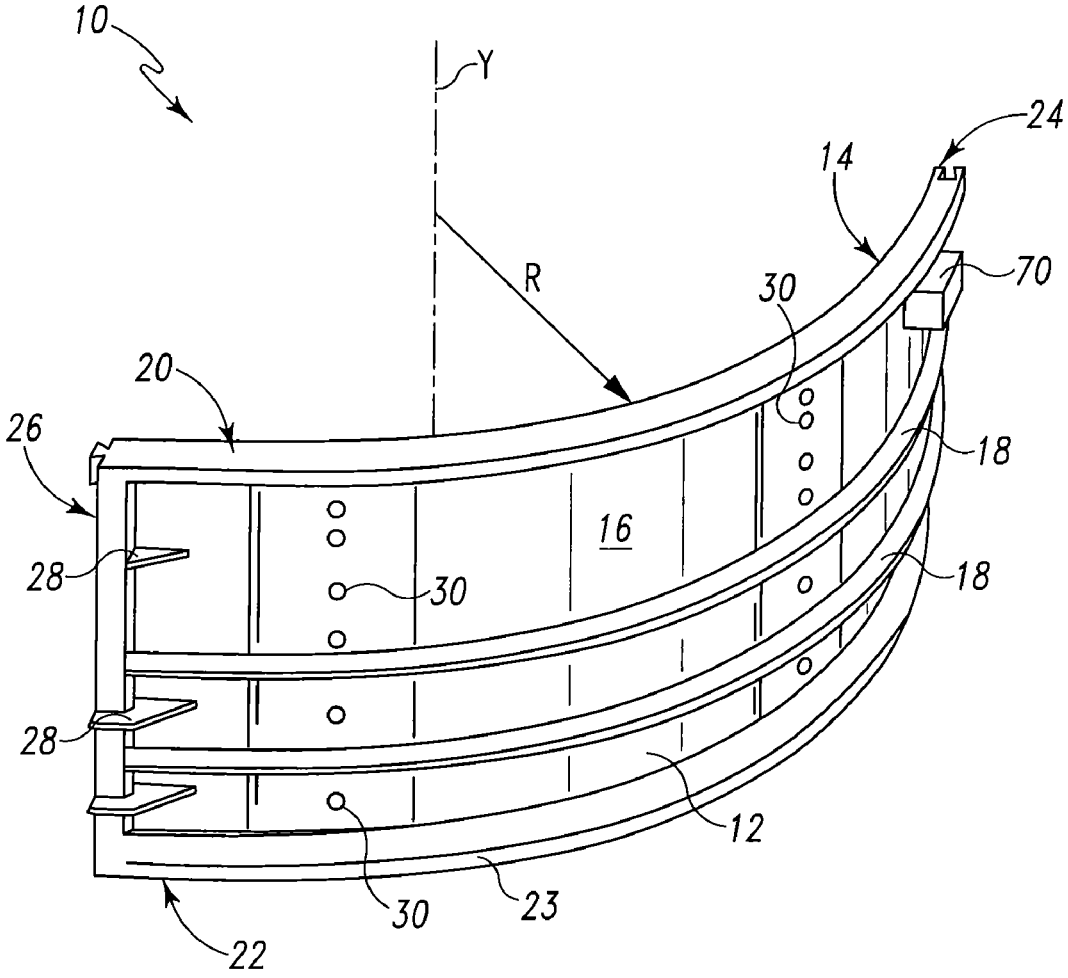
FIG. 1 is a perspective view of one embodiment of a segment of the present invention.

FIG. 1 shows a perspective view of a segment 10 that is useful to form a riser or other subterranean structure as will be seen from the following discussion. The segment 10 has an outer surface 12 and an inner surface 14. The surfaces 12 and 14 are generally parallel to each other and define a cylindrical wall 16 that is curved around an axis Y at a fixed radius R. The radius R in one commercial embodiment is about 50 cm, but could be about 80 cm or even more. The outer surface 12 of the segment 10 is shown to include a plurality of horizontal ribs 18 projecting outward from surface 12 that help to maintain the desired curvature of the wall 16. The segment 10 also has a horizontal top end 20 and a horizontal bottom end 22. Both ends 20 and 22 are parallel to the horizontal ribs 18 and project outward from the surface 12. The top horizontal end 20 and the horizontal ribs 18 can be similarly dimensioned so that they project outward from surface 12 by the same amount of distance. The bottom horizontal end 22 is shown to project outward by a somewhat greater distance than either the top horizontal end 20 or the horizontal ribs 18. The bottom horizontal end 22 is also shown to include a downwardly extending lap portion 23 that can be used to overlap an outer edge of a top feature of an adjacent structure.

The segment 10 also has vertical side edges 24 and 26, which are discussed in more detail below. The vertical side edges 24 and 26 can be braced by gussets 28 extending between an outer portion of the vertical side edge and the surface 12 of wall 16. The outer surface 12 can also include a plurality of dimples 30 that are designed to act as a centering device facilitating the drilling of a hole in the wall 16 to allow various equipments to be mounted to the wall 16. The inside surface 14 can also include dimples 30 as well as one or more planar regions 31, shown in FIG. 10, to facilitate the mounting of equipment such as electrical boxes 33 and the like to the surface 14. The inside surface 14 can also include a groove 21 adjacent the top horizontal end 20 for interaction with a cover locking mechanism, such as is shown in FIGS. 12-15.

Figure 2:
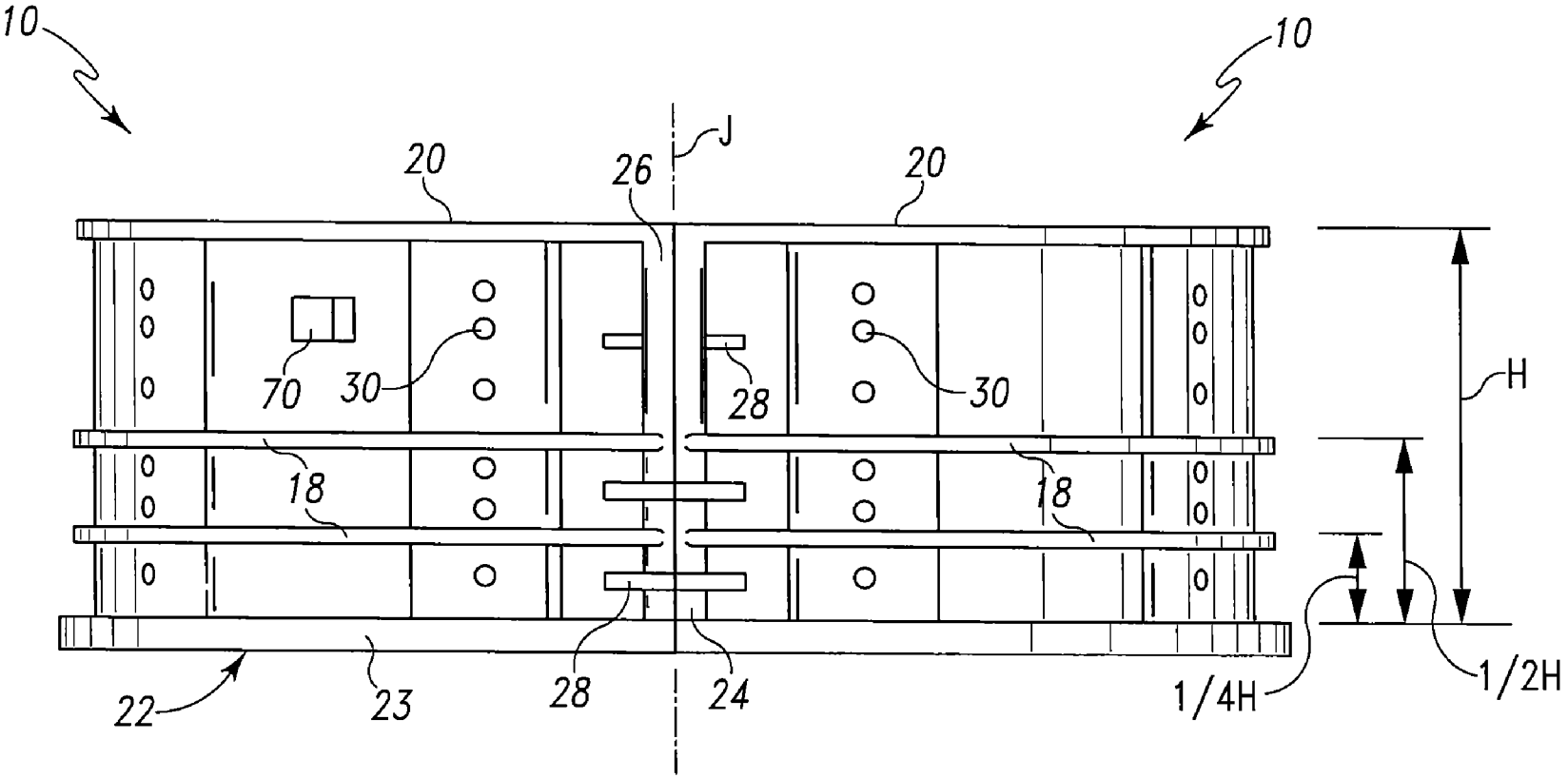
FIG. 2 is a side elevation of two segments of the present invention shown connected together by adjacent vertical side edges.

An adjacent pair of the segments 10 can be joined together as shown in FIG. 2 so that the vertical side edge 24 of one segment is in abutting relationship with the vertical side edge 26 of the other segment along a plane J. When fully joined together, the top horizontal ends 20 of both segments 10 are aligned with each other as are the bottom horizontal ends 22. Further, the top and bottom horizontal ends 20 and 22 are separated by a distance H representing the height of the segments 10. The downwardly extending lap portion 23 extends below the lower margin of the distance H by a much smaller distance h. The distance H in one commercial embodiment is about 23 cm while the much smaller distance h is about 1.1 cm.

It can be seen from FIG. 2 that one of the horizontal ribs 18 is spaced from the bottom horizontal end 22 by about ½H while the other horizontal rib 18 is spaced from the bottom horizontal end 22 by about ¼H. This spacing of the horizontal ribs 18 can facilitate the horizontal sectioning of the segments 10 immediately above either of the horizontal ribs 18 to form vertically shortened segments that have an upper horizontal end that is formed by one of the horizontal ribs 18. When so shortened, the horizontal rib 18 forming the upper horizontal end can interact with a downwardly extending lap portion 23 of a vertically adjacent bottom horizontal end 22 to correctly position the vertically adjacent surfaces with respect to each other, which is illustrated in the example shown in FIG. 10, discussed below.

Figure 3:
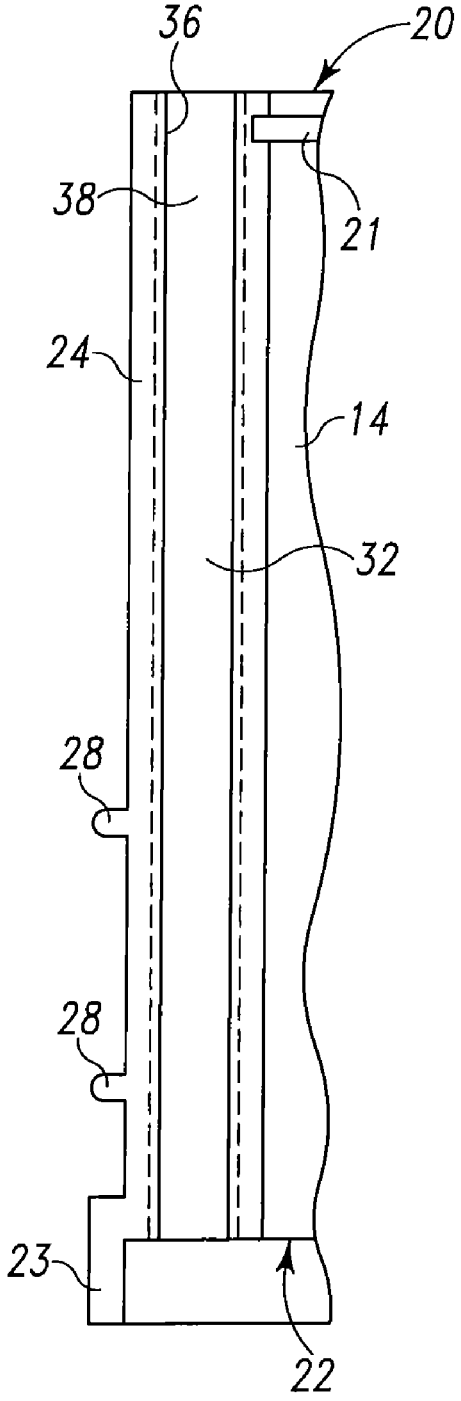
FIG. 3 is an end elevation view of one of the vertical side edges of a segment of the present invention.
Figure 4:
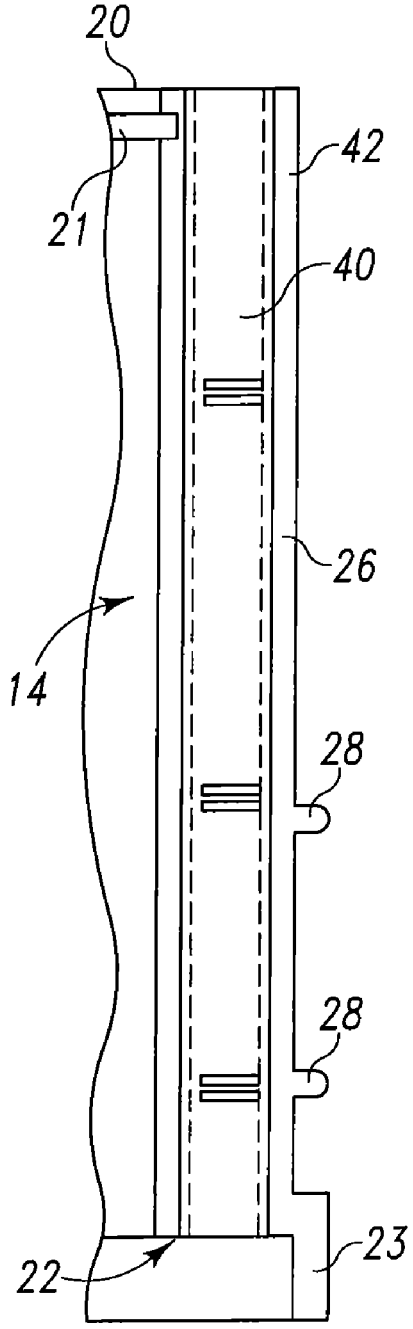
FIG. 4 is an end elevation view of another of the vertical side edges of a segment of the present invention.
Figure 5:
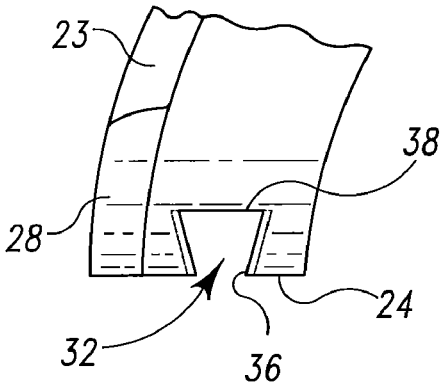
FIG. 5 is a plan view of the vertical side edge shown in FIG. 3.
Figure 6:
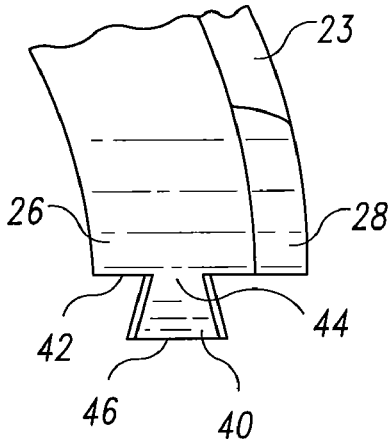
FIG. 6 is a plan view of the vertical side edge shown in FIG. 4.
Figure 7:
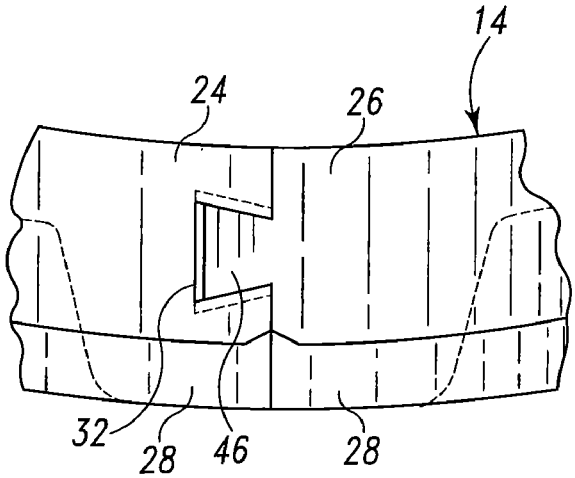
FIG. 7 is a plan view of two assembled vertical side edges.

One mechanism for facilitating the junction of the vertical side edges 24 and 26 is shown in FIGS. 3 to 7. One vertical side edge 24 is shown in FIGS. 3 and 5 to include a slot 32 that extends into the surface 34 of the side edge 24. The neck portion 36 of the slot 32 that is adjacent to the surface 34 is narrower than the root portion 38 of the slot 32. Additionally the slot 32 is vertically tapered so that the width of the neck portion 36 of the slot adjacent to the upper horizontal end 20 is narrower than the width of the neck portion 36 adjacent to the lower horizontal end 22. The other vertical side edge 26 is shown in FIGS. 4 and 6 to include a protruding mating element 40 projecting from surface 42. The protruding element 40 has a proximal portion 44 adjacent to the surface 42 that is smaller than distal portion 46. Additionally, the width of the distal portion 46 tapers vertically so that the protruding element 40 is wider adjacent to the bottom horizontal surface 22 and narrower adjacent to the upper horizontal surface 20. The tapered protruding element 40 of vertical side edge 26 is preferably sized and shaped to be received in the tapered slot 32 of vertical side edge 24 as shown in FIG. 7.

The engagement of the tapered protruding element 40 into the tapered slot 32 requires that two adjacent segments 10 be vertically moved relative to each other. While the tapered protruding element 40 and tapered slot 32 are shown in FIGS. 3-7 to be dove-tailed in configuration, other cross-sectional configurations are possible including circular, ovate, elliptical, etc. Further, while FIGS. 3-6 show only a single protruding element 40 and a single tapered slot 32, it is also possible that additional protruding elements and tapered slots could be used that are horizontally or vertically situated relative to each other. The slots 32 and protruding elements 40 should be sized in relation to each other so that as the protruding element is increasing received in the taper slot, the surfaces 24 and 42 become increasingly close to each other, and finally come into complete abutting relationship when the upper horizontal surfaces 20 of the two adjacent segments 10 are coplanar as shown in FIG. 2.

Figure 8:
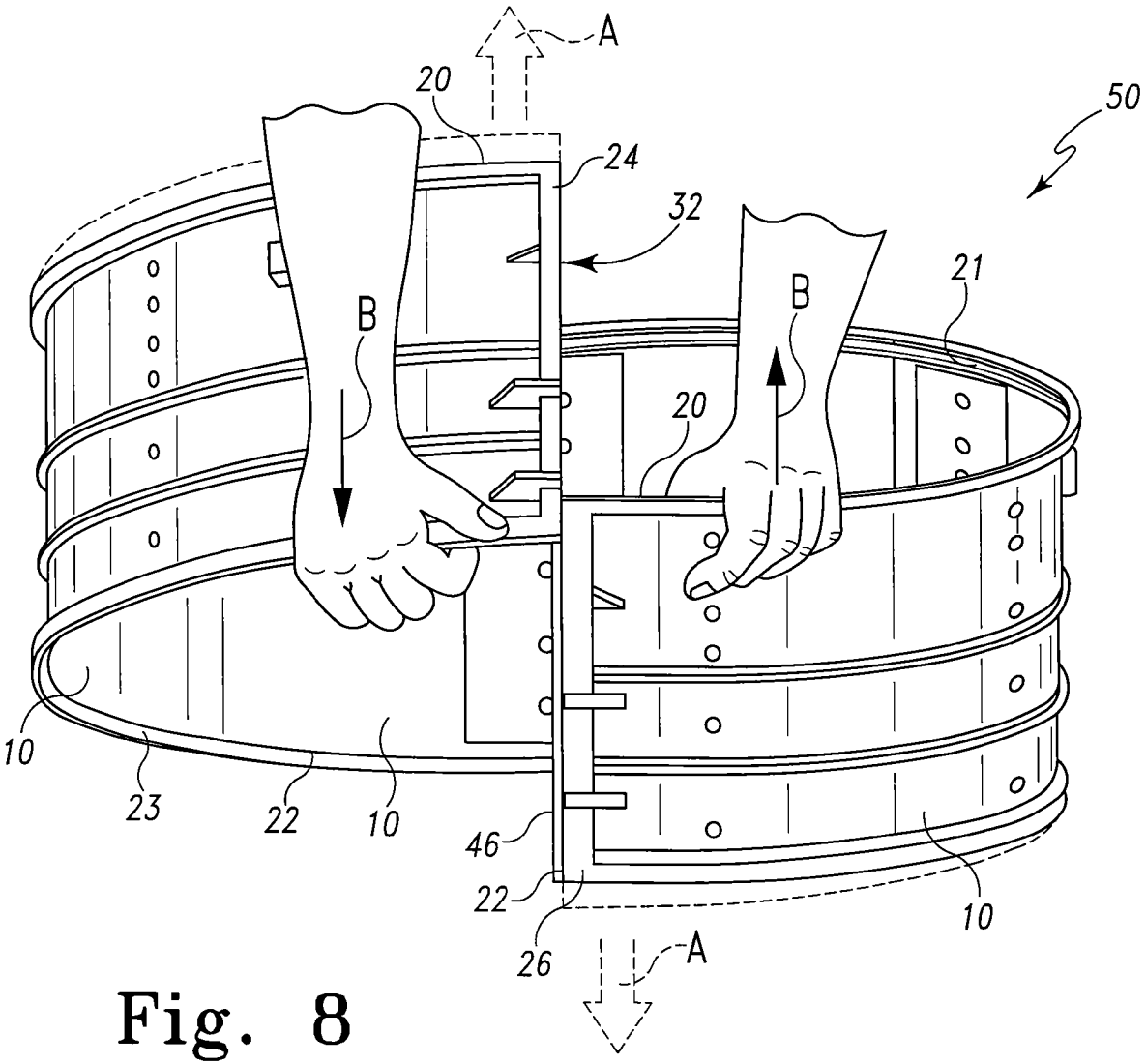
FIG. 8 is a perspective view of the assembly of the last two adjacent vertical side edges to form a ring of the present invention.

A method for the assembly of a plurality of the curved segments 10 into a ring 50 is illustrated in FIG. 8. First, the protruding mating element 40 of one segment 10 is slipped into the vertically tapered slot 32 of an adjacent segment until the top and bottom ends 20 and 22 of the adjacent segments are aligned. This operation is repeated with additional segments 10 until sufficient segments, usually three, are joined together horizontally to complete a ring 50 except for a last adjacent pair of vertical side edges 24 and 26. The segments 10 forming the ring 50 are then warped in the direction of arrows A by a distance sufficient to insert and align the protruding mating element 40 of the last adjacent pair of vertical side edges with the adjacent tapered slot 32. The aligned protruding mating element 40 and tapered slot 32 are then slipped together in the direction of arrows B while un-warping the joined segments 10 to form the remainder of the ring until the top and bottom ends 20 and 22 of all the segments 10 are aligned.

While FIG. 8 shows the ring 50 being warped by a distance nearly sufficient to align the bottom end surface 22 of one segment 10 with the top end surface 20 of the adjacent segment, it will be appreciated that the warping distance need be only that sufficient to allow the distal end 46 of the protruding element 40 to be slipped through the neck portion 36 of the adjacent slot 32. While a completely satisfactory ring 50 can be formed and used relying merely on the mechanical connections between the mating elements 32 and 40 of the several adjacent vertical side edges 24 and 26, bonding agents compatible with the polymers forming the segments 10 can also be used during or after assembly of a complete ring 50 to permanently secure the segments 10 to each other.

The vertical orientation of the interlocking mating element 40 and tapered slot 32, as distinguished from a horizontal orientation commonly used in many prior art structures, insures that the same type of warping action is necessary to separate one segment 10 from another. Unlike the assembly motions of many prior art devices, this warping action is unlikely to occur as a result of earth movement adjacent to an assembled riser that has been installed in a subterranean environment. As a result, a riser constructed with the present invention has an added margin of strength and security that is not provided by other structures.

The segments 10 can be made from a wide range of polymers including, without limitation, PC, PVC, DHPP, HDPE and ABS. The polymers desirably have the required properties of strength, stability, impact resistance, and bondable using non-toxic cements that are generally available in the trade. A suitable polymer is, for example, Cycolac® GPX3800 available from GE Plastics. Cycolac® GPX3800 is an ABS plastic having a typical tensile strength of 5400 psi, flexural strength of 9600 psi, and an Izod impact resistance of 8.4 at 73° F.

Figure 9:
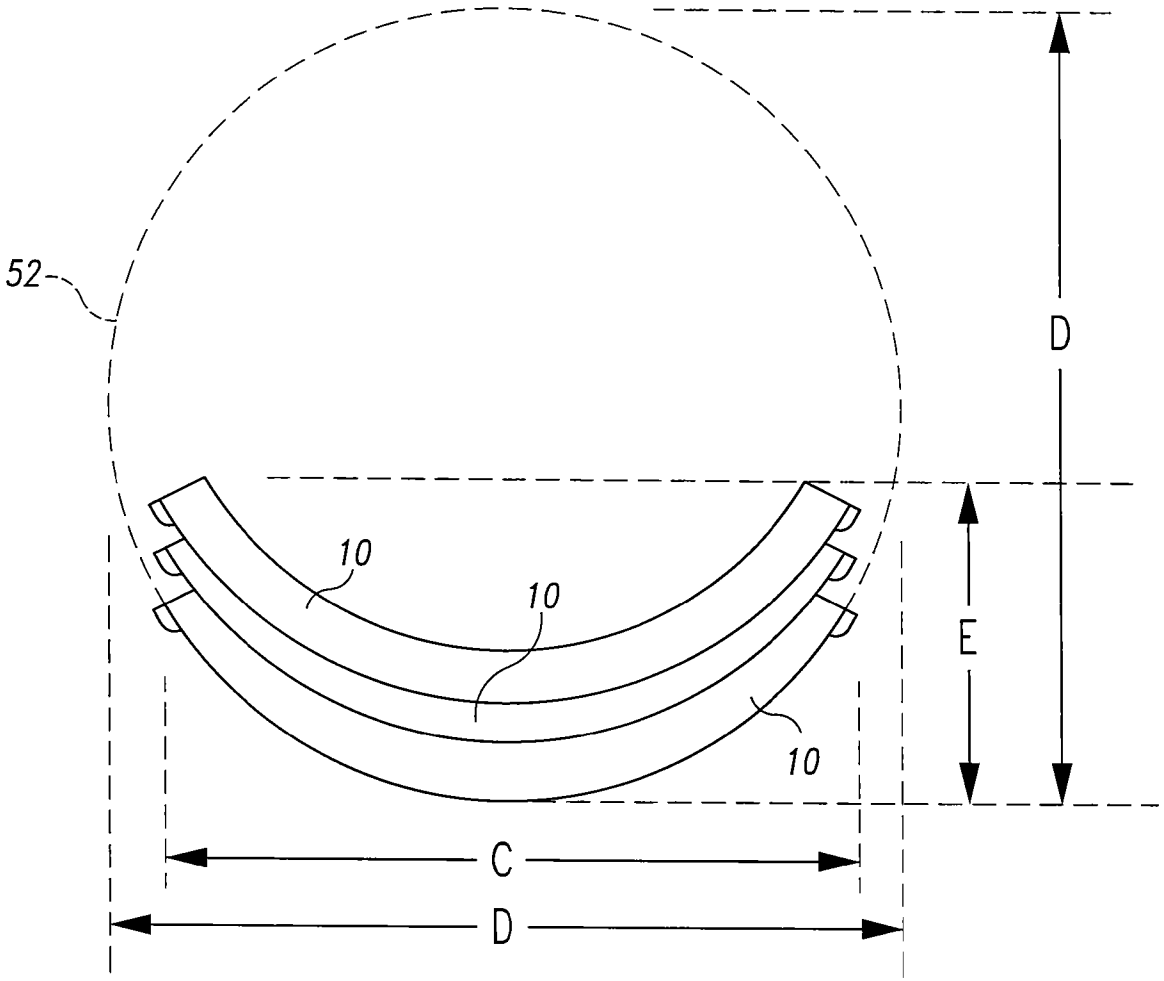
FIG. 9 is a schematic end elevation view of a plurality of the segments of the present invention arranged for shipment.

The modular design of the riser segments 10 conserves shipping and storage space as shown in FIG. 9. Many conventional risers are formed as one piece units represented by the phantom circle 52 having a height D and a width D. By contrast, three of the segments 10 are shown stacked for shipment or storage within a width C and a height E. Where the segments 10 occupy 120° of arc around the ring 50 of the same size as circle 52, the width C≈0.87 D and the height E≈0.35 D. Thus, a stack of segments 10 necessary to construct a ring 50 of the same size as circle 52 occupies less than 40% of the space occupied by the circle 52, which represents substantial savings in storage and shipping costs.

Figure 10:
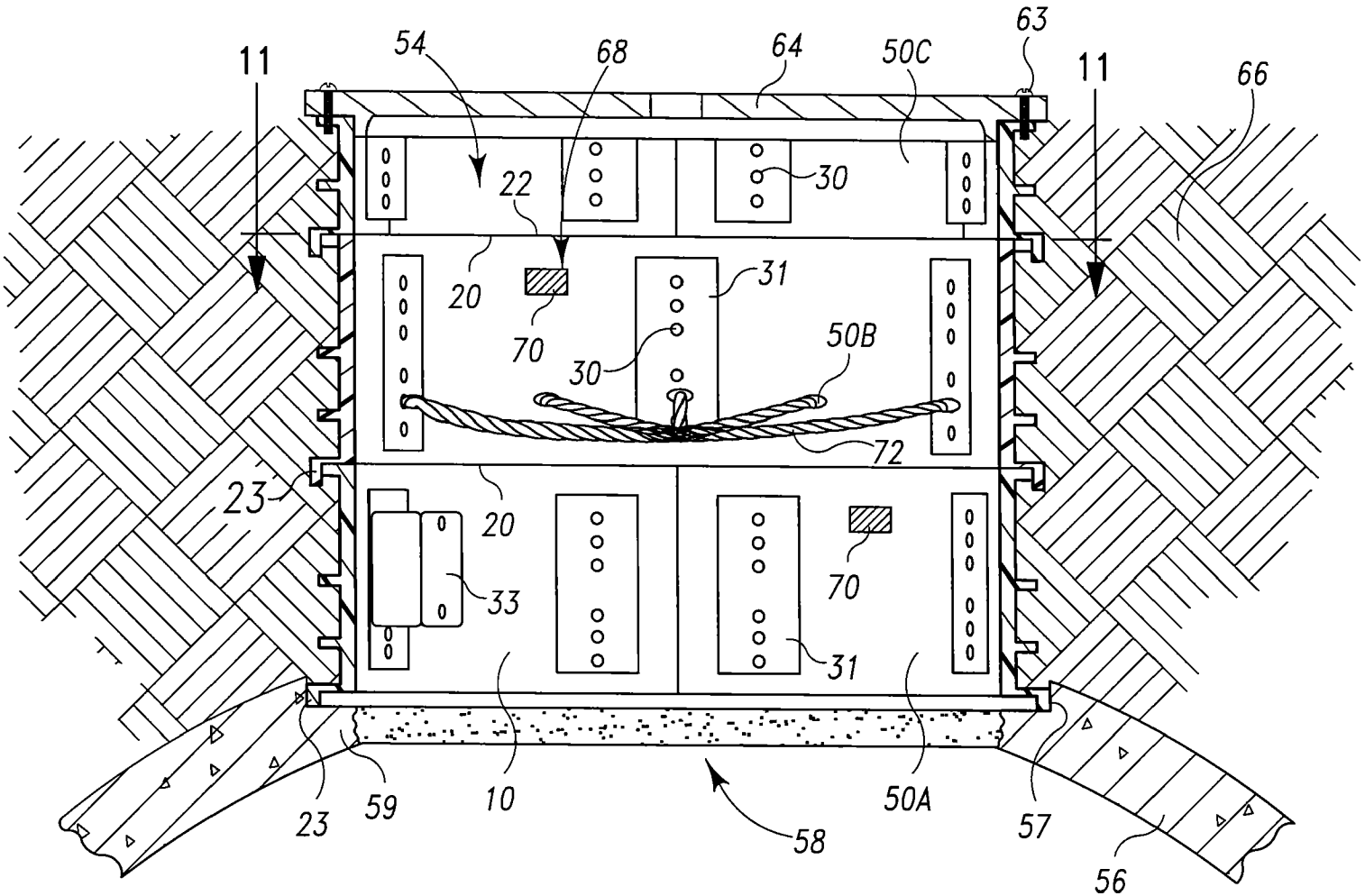
FIG. 10 is a sectional view of a riser constructed using a plurality of rings formed from segments of the present invention.

An access chamber, riser, or other subterranean structure 54 can be assembled from a stacked series of rings 50 formed from the segments 10 as shown in FIG. 10. The subterranean structure 54 is shown situated on top of a subterranean structure 56 such as a tank or basin that includes an access opening 58 including a ledge 59 surrounded by an upstanding lip 57. A lower most ring 50A is assembled and situated over the opening 58 so that an outer surface 60 of the downwardly extending lap portion 23 is received within the lip 57 to assure centering of the ring 50A with respect to the opening 58. A second ring 50B and a vertically shortened third ring 50C are then stacked on ring 50A. A vertically shortened segment can be used, of course, at any point in a vertical stack of segmented rings 50.

With each succeeding ring 50, the downwardly extending lap portion 23 of the upper ring can be positioned to surround the junction of the now contiguous horizontal upper and lower surfaces 20 and 22, to assist in centering the rings 50 one on the other, and to deflect moisture away from the horizontal surface junction. Again, a suitable bonding agent can be employed between the abutting surfaces 20 and 22, if desired, but is not necessary to complete a structure of the present invention. A suitable cover plate 62, such as a standard cast iron manhole cover, can be added to restrict access to the subterranean structure 54. The cover plate 62 can be secured to the horizontal upper surface 20 of the uppermost ring 50 by suitable fasteners 63 as are typically used in the trade. Appropriate back fill 66 can be added to surround the rings to aid in stabilization of the manhole 54 with respect to the structure 56.

Figure 11:
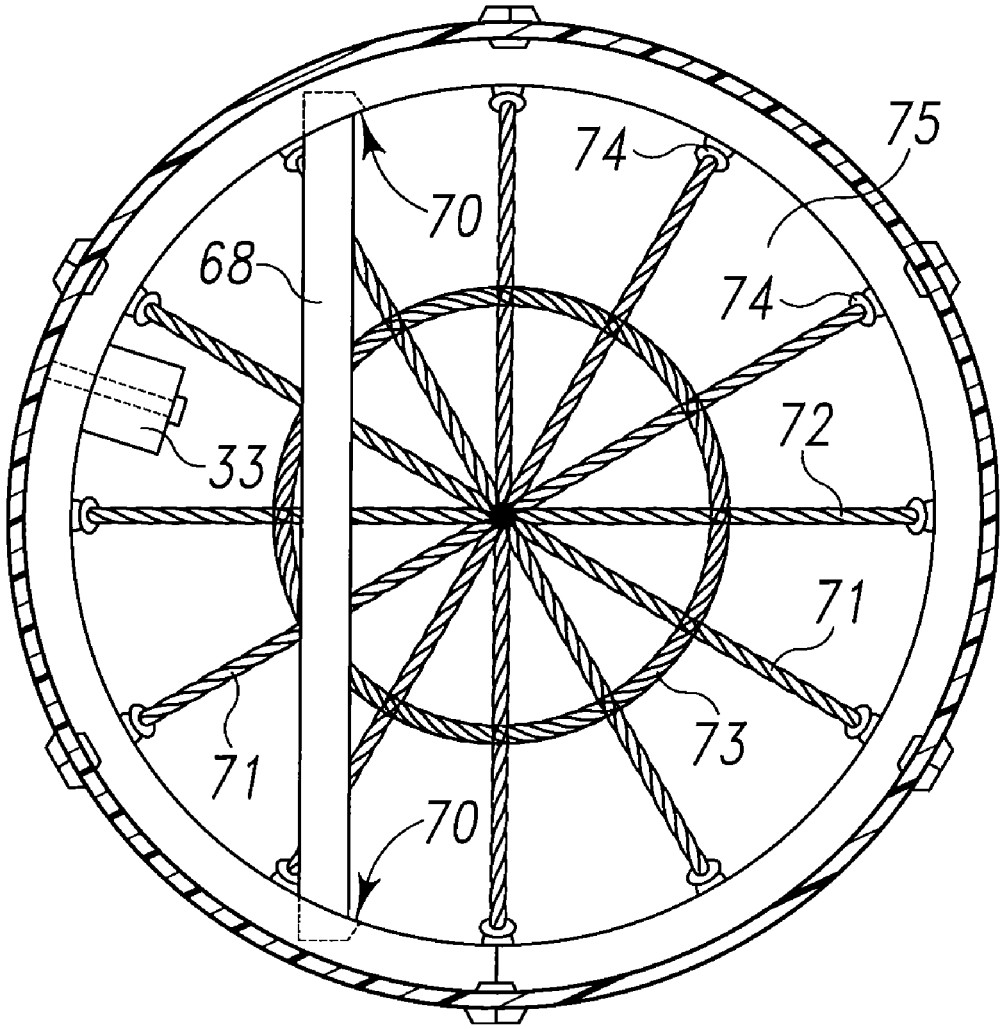
FIG. 11 is sectional view taken along line 11-11 shown in FIG. 10.

FIG. 11 is sectional view taken along line 11-11 shown in FIG. 10 and shows a bar 68, which can comprise a rung of a ladder, an equipment support or other similar structure, that is mounted in pockets 70 that are formed in the inner wall of the segments 10. A security net 72 can be suspended from a plurality of fasteners 74 that are fixed in holes drilled in selected dimples 30. The security net 72 can comprise a plurality of radial strands 71 and circular or other crossing strands 73, coupled to each other, the strands preferably made of polypropylene rope of sufficient diameter to inhibit accidental entry into the subterranean structure 54 by small animals and children. A preferred diameter is at least about 5 mm. The security net 72 can still include small openings 75 of sufficient size to allow access to any tank or basin 56 by a suction hose while inhibiting accidental entry.

Figure 12:
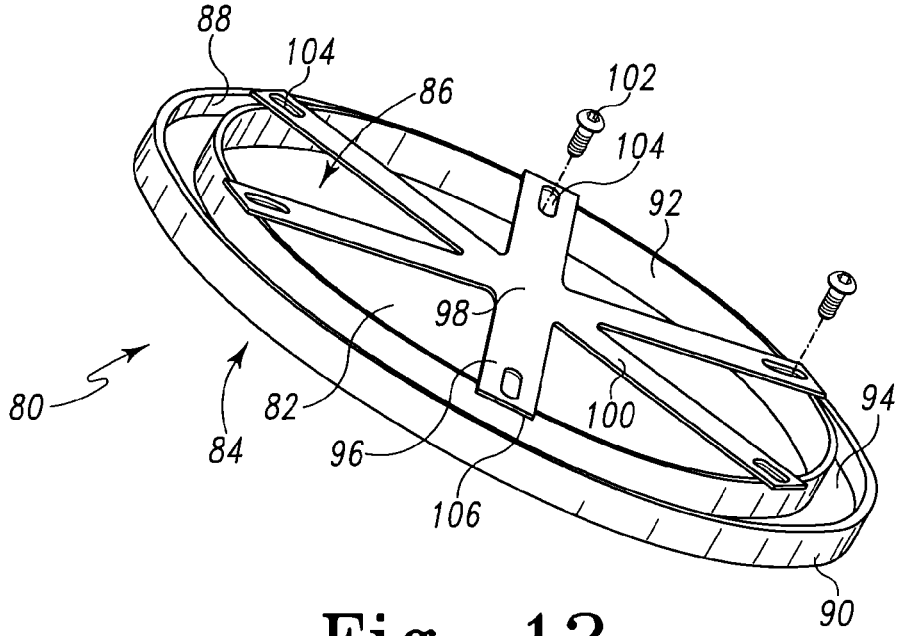
FIG. 12 is a exploded perspective view of a spider latch on a cover that can be used with a riser of the present invention.
Figure 13:
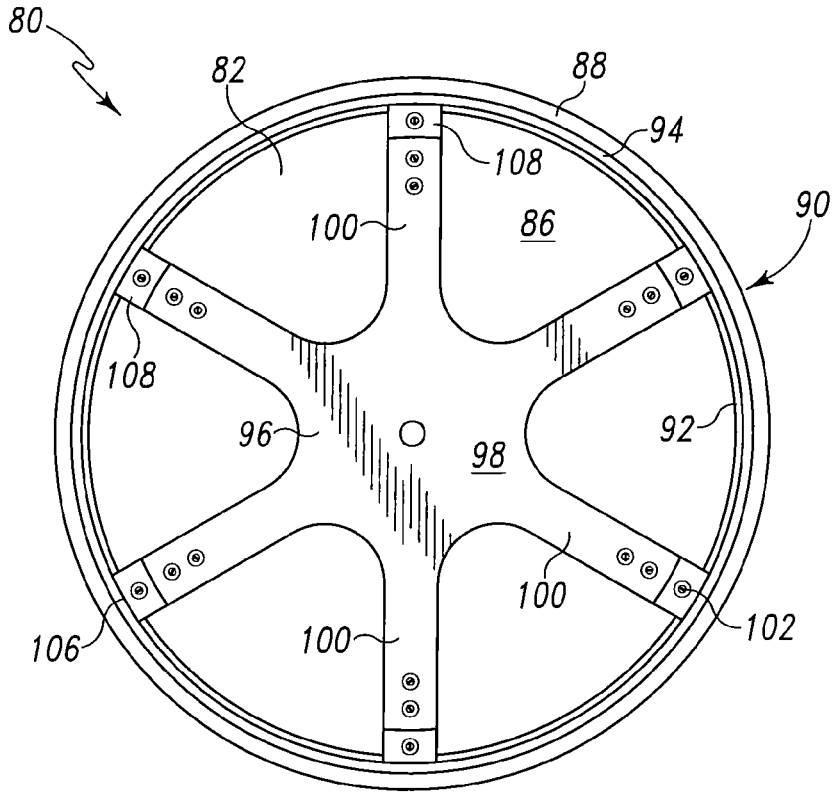
FIG. 13 is a bottom plan view of the cover shown in FIG. 12 engaged with a riser.
Figure 14:
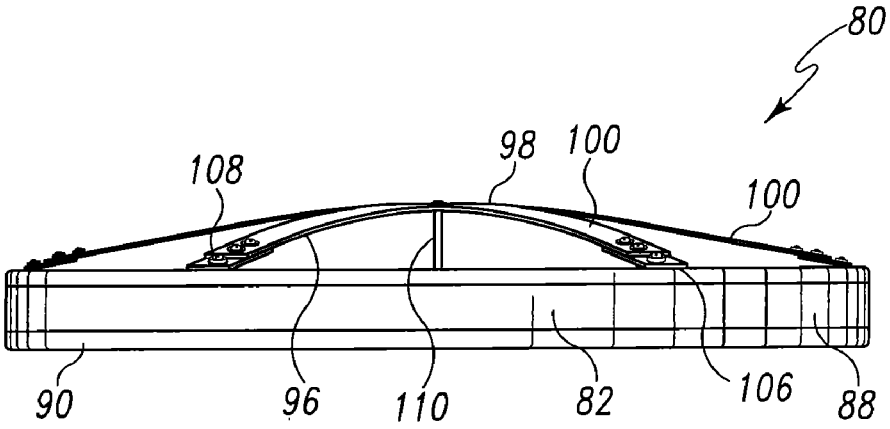
FIG. 14 is a side elevation view of the cover shown in FIGS. 12 and 13 with the spider displaced to an un-locked position.
Figure 15:
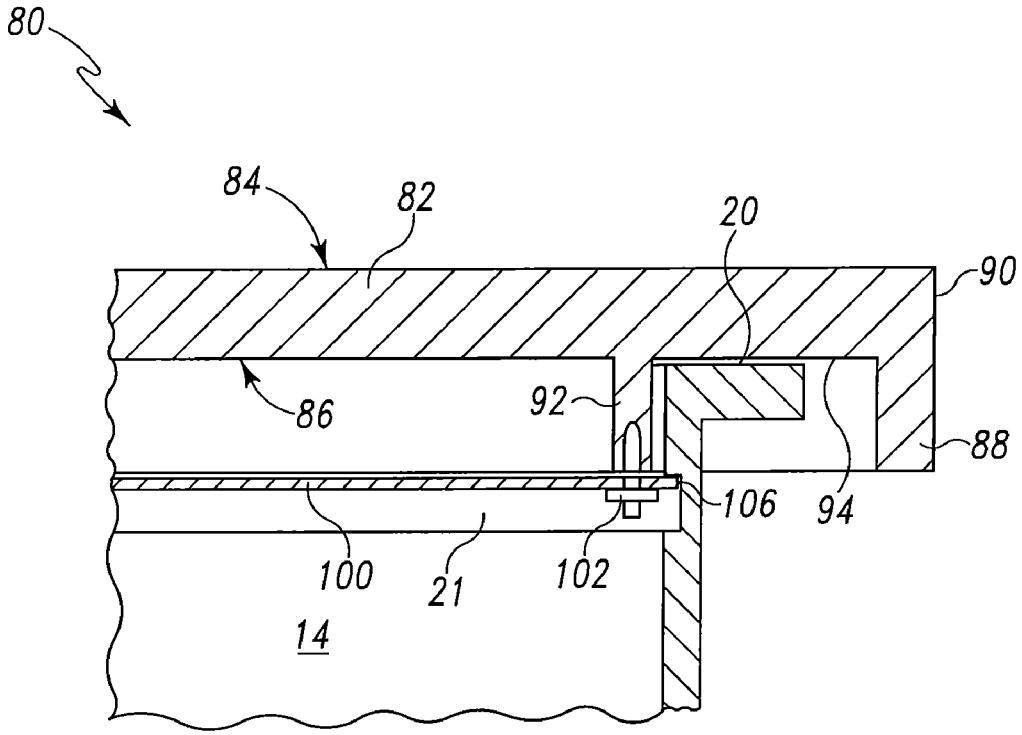
FIG. 15 is a sectional detail view of one leg of the spider lock engaged in a groove in the sidewall of the riser.

A locking cover 80 is shown in FIGS. 12-16 that is intended to restrict entry into the subterranean structure 54 by unauthorized personnel. The locking cover 80 includes a plate 82 having an upper surface 84 and a lower surface 86. The locking cover 80 can include an outer depending flange 88 that extends downward from an outer perimeter 90 of the plate 82. An inner depending flange 92 can extend downward from the lower surface 86. The outer depending flange 88 and inner depending flange 92 are spaced from each other by a distance sufficient to receive an upper horizontal end 20 of a riser formed with the segments 10 to contact a rim portion 94 of the lower surface 86 situated between the flanges 88 and 92. A flexible spider 96 having a center portion 98 and a plurality of radially extending legs 100 is coupled to the inner depending flange 92 of the lower surface 86 by coupling elements 102, which can be screws, bolts, brackets, or other suitable fasteners. The spider 96 is shown to have six legs, but can have three or more legs and still perform the intended function. The legs 100 of the spider 96 can flex with respect to the center portion 98 as shown in FIG. 14. The coupling elements 102 allow radial movement of the legs 100 with respect to the flange 92. The coupling elements 102 can extend through elongated slots 104 in the legs 100. The arrangement of the legs relative to the locking cover is such that as the cover is locked in place, the cover tends to be automatically centered on the upper horizontal end 20 of the riser.

A distal end 106 of each leg 100 is adapted to protrude into the groove 21 on the inner surface 14 of the riser segments 10 to lock the cover 80 in place. Alternatively, a ring of material such as polyethylene or epdm rubber that is sufficiently soft to engage the ends 106 of the legs 100 can be placed as a lining adjacent to the upper horizontal end 20 of the riser. The spider 96 shown in FIG. 12 is seen to be a single unitary structure; however, the distal ends 106 of the legs 100 can be in the form of separate elements 108 as shown in FIGS. 13 and 14. The legs 100 of the spider 96 can flex with respect to the center portion 98 as shown in FIG. 14 to withdraw the distal ends 106 from the groove 21 to permit the cover 80 to be removed from the riser. The flexing of the spider 96 can be achieved with a key 110 adapted to fit through a suitable opening 114 in the cover 80 as shown, for example, in FIGS. 18 and 19. The force necessary to displace the center portion 98 of the spider 96 can be controlled by selection of the material forming the spider 96 as well as the thickness and width of the legs 100 and the size of the center portion 98. The spider 96 can be formed from any flexible, and preferably elastic, material that can resist the environmental conditions within the riser. Desirable materials include stainless steel and a wide range of polymers including, without limitation, PC, PVC, DHPP, HDPE and ABS. A preferred material for forming the spider 96 is 304 stainless steel having a substantially uniform thickness of about 1 to 2 mm, and preferably 1.83 mm. The diameter of the center portion 98 can be about from about 10 to 25 cm while each of the legs can be about 4 to 10 cm wide.

Figure 16:
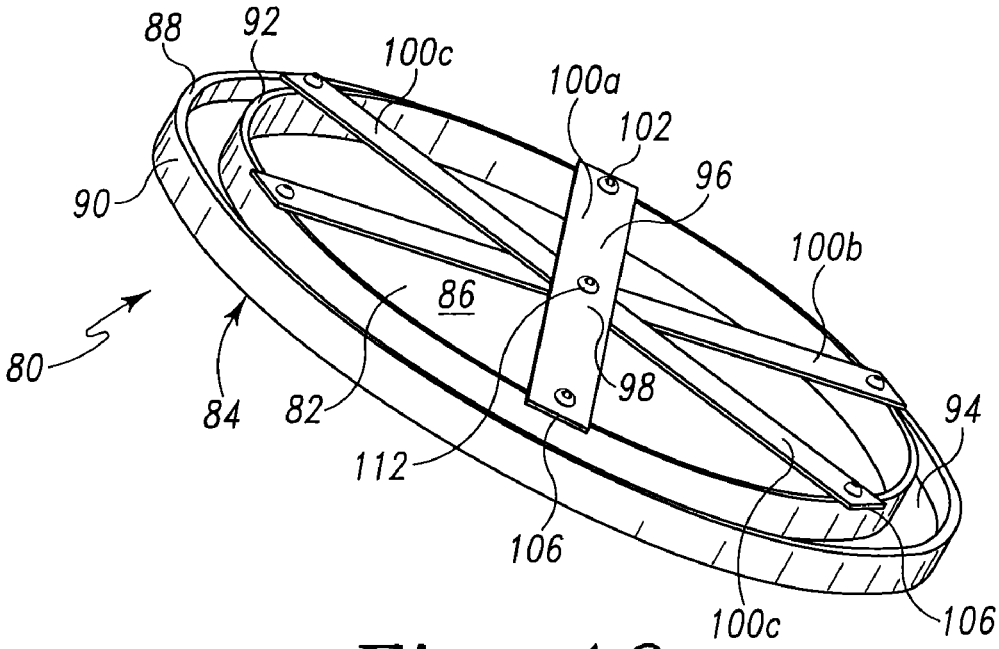
FIG. 16 is a perspective view of another spider latch on a cover that can be used to secure a cover to a riser.

Another alternative form for the spider 96 is shown in FIG. 16. The spider 96 has legs 100*a*, 100*b* and 100*c*, each of which are formed of a separate strip of material of the character described in the forgoing paragraph. A bonding element 112 such as a rivet or spot weld can couple the legs 100*a*, 100*b*, and 100*c*, together to form an overlapping center portion 98. The legs 100 of any configuration of spider 96 need not be of the same length so that locking contact between the ends 106 and the adjacent riser need not occur simultaneously.

Figure 17:
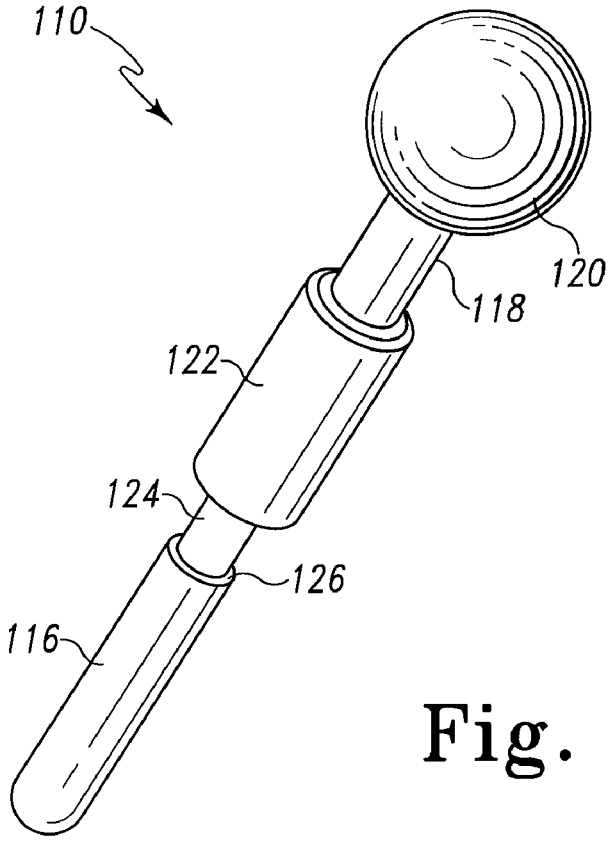
FIG. 17 is a perspective view of a key that can be used to unlock a cover having a spider latch.
Figure 18:
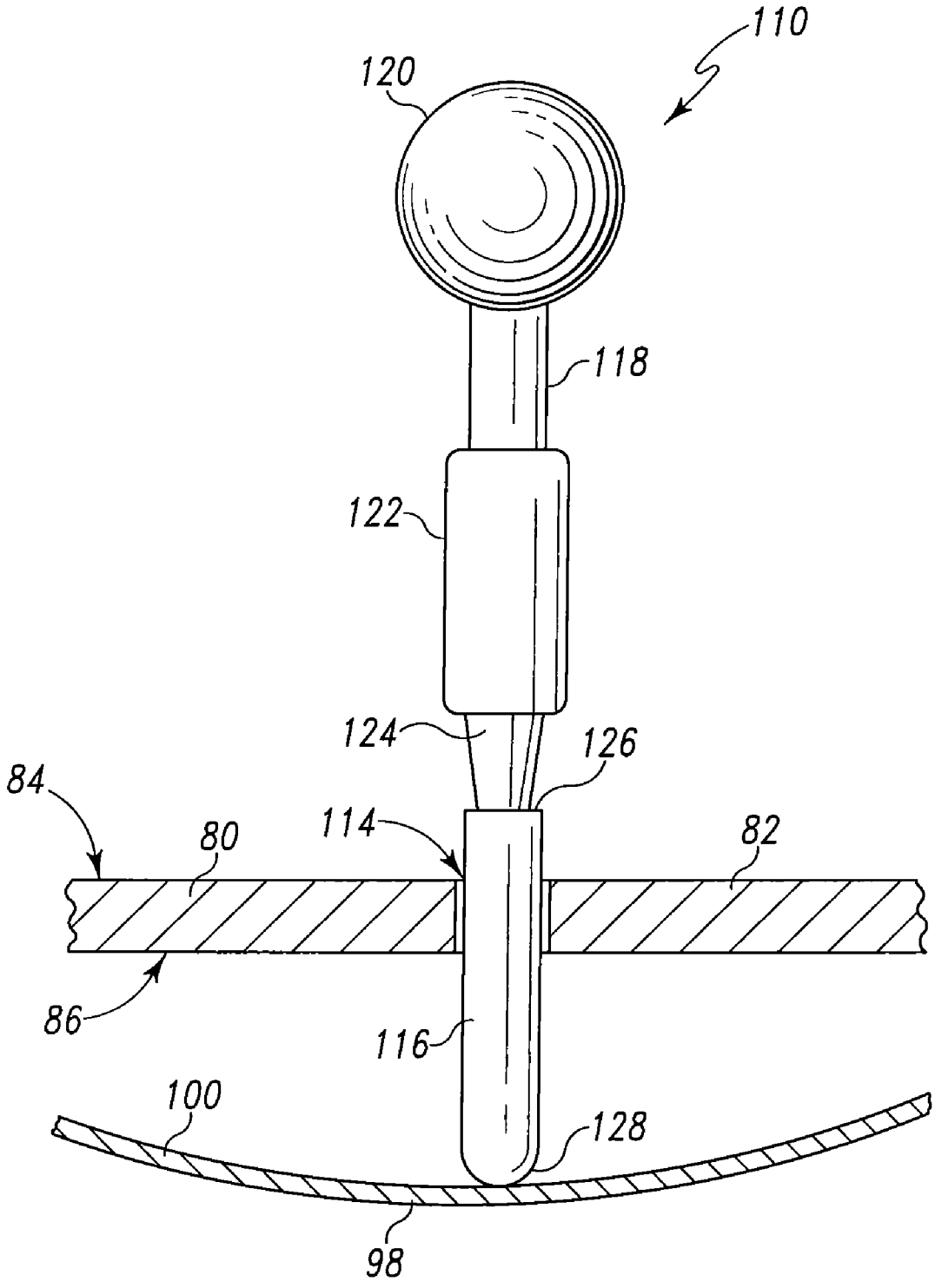
FIG. 18 is a side elevation view of the key shown in FIG. 17 partially inserted thought a cover shown in section.
Figure 19:
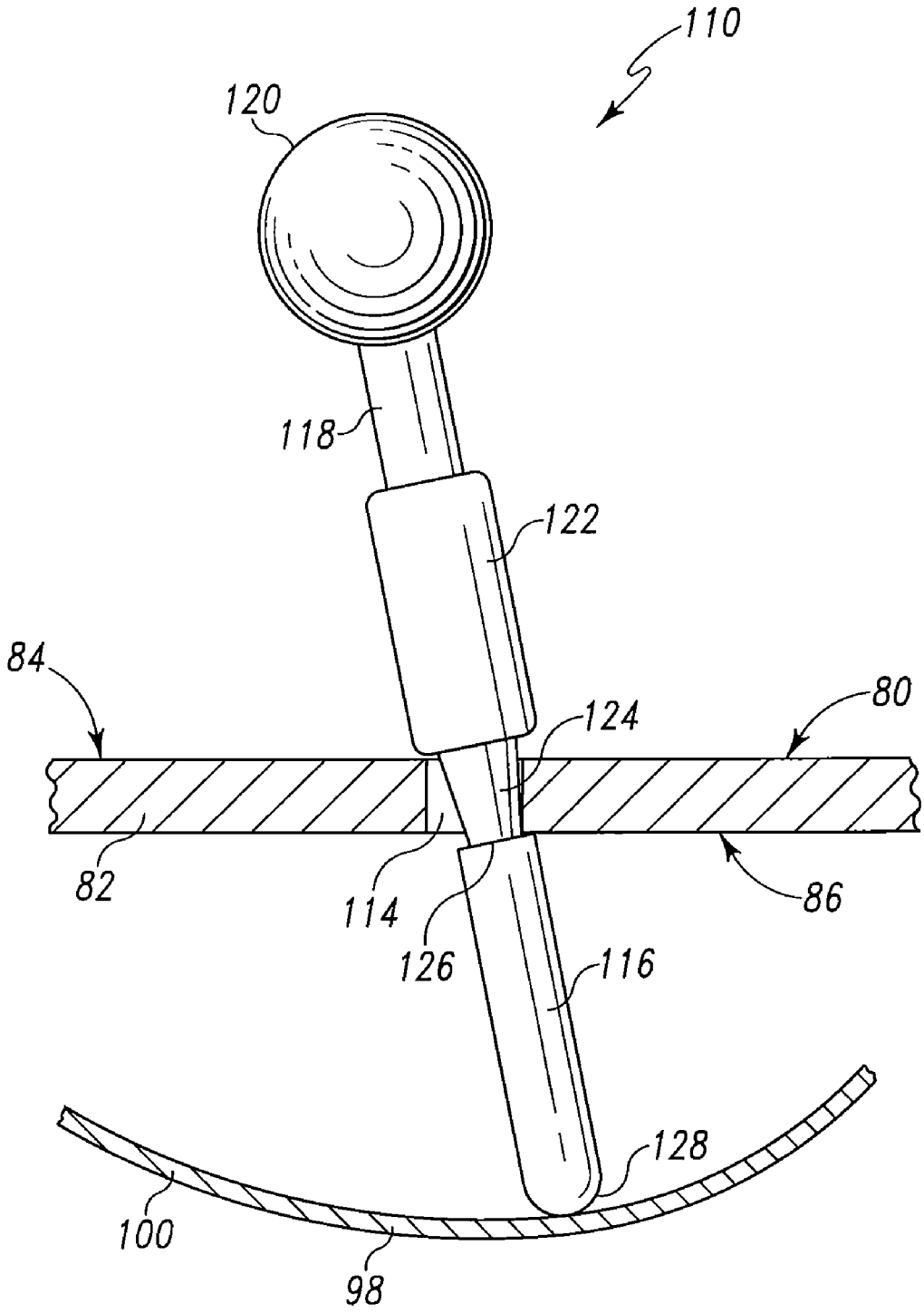
FIG. 19 is a side elevation view similar to FIG. 18 showing the key in a locked position.

A central opening 114 can be provided in the locking cover 80 to provide access for a key 110. A preferred key 110 is seen in FIGS. 17-19 to have a lower stem portion 116 of a diameter sufficiently small to be received in the central opening 114 of the locking cover 80. An upper stem portion 118 can have an enlarged end 120 forming a handle facilitating manipulation of the key 110. A collar 122 surrounds the upper stem portion 118. The collar diameter sufficiently large to prevent insertion of the collar 122 into central opening 114 of the locking cover. A tapered portion 124 is situated below the collar 122 that includes a step edge 126 adjacent the lower stem portion 116. As the key 110 is inserted into the central opening 114 of the locking cover 80, a lower end 128 of the key 110 depressed the center portion 98 of the spider as shown in FIGS. 14 and 18. Upon substantially full insertion of the key 110 into the central opening 114, the key 110 can be displaced to any side as shown in FIG. 19 so that the step edge 126 engages the lower surface 86 of the cover 80 adjacent to the central opening 114. The position illustrated in FIG. 19 can be considered as an "open" position for the key since the downward flexing of the center portion 98 of the spider 96 is such that the ends 106 of the legs 100 are withdrawn from engagement with any feature on the inner surface 14 of the riser, allowing the locking cover 80 to be removed. To return the locking cover 80 to a "locked" position, one need merely return the key to an upright orientation in alignment with the central opening 114, whereupon the elastic nature of the legs 100 will propel the key 110 out of the opening 114.

While particular embodiments of the invention have been shown and described with reference to the drawings, it is recognized that variations and modifications thereof will occur to those skilled in the art. It is therefore intended that the foregoing detailed description be regarded as illustrative rather than limiting, and that the following claims, including all equivalents, are intended to define the spirit and scope of this invention.

The invention claimed is:

1. A subterranean structure having a body cylindrical about a vertical axis, made up of at least one ring, each ring consisting essentially of a plurality of horizontally adjacent segments of molded plastic, each segment comprising:

a wall element cylindrically curved about a vertical axis having an inside surface and an outside surface, vertical side edges and horizontal top and bottom ends, a first of the vertical side edges including a protruding mating element that is vertically tapered, and a second of the vertical side edges including a slot that is vertically tapered, the vertical side edges including confronting surfaces brought into abutting relationship solely by an interlocking engagement between the vertically tapered mating elements and vertically tapered slots on the horizontally adjacent segments of similar construction, wherein the protruding mating element on each segment comprises a dovetail extending continuously along the first vertical side edge, the dovetail including a proximal portion adjacent to the first vertical side edge and a distal portion opposite the proximal portion, the proximal portion being narrower than the distal portion, and the distal portion having a width of continuously varying dimension in a vertical direction to achieve the vertical taper.

2. A subterranean structure of claim 1 wherein each, segment further comprises a protuberance on a surface of each protruding dovetail and a corresponding surface feature on a surface of each dovetail slot providing interference between interlocking vertical surfaces when the horizontal ends of two adjacent segments are aligned.

3. A subterranean structure of claim 1 further comprising a plurality of dimples on a surface of each element facilitating the drilling of holes for mounting hardware to the surface.

4. A subterranean structure of claim 3 further comprising a security net including a plurality of radial strands and crossing strands coupled to the radial strands, and a plurality of fasteners coupled to the ends of the radial strands for connecting the radial strands to said mounting hardware on the inside surface of the subterranean structure, the strands being fixed sufficiently close to each other to inhibit accidental entry into the subterranean structure by small animals and children while still providing small openings of sufficient size to allow access by a suction hose or the like.

5. A subterranean structure of claim 1, wherein the at least one ring forms a vertical access chamber, the subterranean structure further comprising a security net having a plurality of radial strands and crossing strands coupled to the radial strands, and a plurality of fasteners coupled to ends of the radial strands, the fasteners configured to couple the radial strands to an inside surface of the vertical access chamber, the radial and crossing strands being fixed sufficiently close to each other to inhibit accidental entry into the subterranean structure by small animals and children while still providing small openings of sufficient size to allow access by a suction hose or the like.

6. A subterranean structure comprising a body and a cover, the body cylindrical about a vertical axis and made up of at least one ring, each ring consisting essentially of a plurality of horizontally adjacent segments of molded plastic, each segment comprising:

a wall element cylindrically curved about a vertical axis having an inside surface and an outside surface, vertical side edges and horizontal top and bottom ends, a first of the vertical side edges including a protruding mating element that is vertically tapered, and a second of the vertical side edges including a slot that is vertically tapered, the vertical side edges including confronting surfaces brought into abutting relationship solely by an interlocking engagement between the vertically tapered mating elements and vertically tapered slots on the horizontally adjacent segments of similar construction, and a continuous groove on the inside surface of the wall elements; and the cover contacting said horizontal top end of an uppermost of the rings forming the subterranean structure, and a flexible spider coupled to the cover having leg ends engaging the continuous groove to secure the cover to the uppermost of the rings.

7. A subterranean structure of claim 6, wherein the cover comprises a plate having an upper surface and a lower surface, the lower surface including an outer rim to contact with said top end, the spider having a center portion and a plurality of radially extending legs, a like plurality of coupling elements coupling at least one of the legs to the lower surface, each leg including the leg end at a distal end thereof, the leg end being adapted to protrude into contact with the inside surface of the subterranean structure, the center portion being movable from the upper surface of the plate to cause movement of the leg ends of the legs relative to the coupling elements between a locked and an unlocked position for securing and releasing the cover to the uppermost ring.

8. A subterranean structure of claim 7, wherein the lower surface of the plate of the cover further comprises of an inner rim movably coupled to the legs of the spider.

9. A subterranean structure of claim 7, wherein the center portion of the spider of the cover is movable in a direction away from the lower surface of the plate, which causes movement of the leg ends of the legs away from the continuous groove of the inside surface of the subterranean structure.

10. A subterranean structure of claim 9, wherein the cover further comprises an opening in the plate aligned with the central portion of the spider for receiving a key inserted from the upper surface of the plate to cause downward displacement of the spider.

11. A subterranean structure of claim 10, wherein the key comprises an axially symmetric rod having a lower portion dimensioned to be received in the opening of the cover and a shoulder of a greater dimension, and a tapered portion between the lower portion and the shoulder allowing lateral displacement of the key relative to the opening of the cover.

12. A subterranean structure of claim 5, wherein each of the radial strands of the security net comprises a portion coupled to at least one other radial strand approximately at a center of the vertical access chamber.

13. A subterranean structure of claim 12, wherein each of the crossing strands is coupled to the radial strands in an intermediate location between the center and the inside surface of the vertical access chamber.

14. A subterranean structure of claim 13, wherein the vertical access chamber is circular, each of the ends of the radial strands is connected to a circumferential region of the inside surface of the vertical access chamber, and each of the crossing strands together form a circular shape.

* * * * *